US005317326A

United States Patent [19]

Tay et al.

[11] Patent Number: 5,317,326

[45] Date of Patent: May 31, 1994

[54] FOLDED DIPOLE ANTENNA

[75] Inventors: Yew S. Tay, Plantation; Oscar Garay, Coral Springs; Jose A. Llorente, North Lauderdale, all of Fla.

[73] Assignee: Motorola, Inc., Schaumburg, Ill.

[21] Appl. No.: 5,203

[22] Filed: Jan. 15, 1993

Related U.S. Application Data

[63] Continuation of Ser. No. 709,247, Jun. 3, 1991, abandoned.

[51] Int. Cl.[5] ..... H01Q 1/12

[52] U.S. Cl. ..... 343/718; 343/803; 343/741

[58] Field of Search ..... 343/702, 718, 803, 866, 343/743, 744, 741, 871, 742; 455/347; H01Q 1/12

[56] References Cited

U.S. PATENT DOCUMENTS 2,888,676 5/1959 Spindler ..... 343/803
4,977,614 6/1990 Kurcbart ..... 455/193
5,128,686 7/1992 Tan et al. ..... 343/718

FOREIGN PATENT DOCUMENTS 825433 11/1951 Fed. Rep. of Germany ..... 343/803
652716 5/1952 United Kingdom ..... 343/803

*Primary Examiner*—Donald Hajec
*Assistant Examiner*—Hoanganh Le
*Attorney, Agent, or Firm*—Michael J. Buchenhorn; Pablo Meles; Lesley Ann Rhyne

[57] ABSTRACT

A modified folded dipole antenna (20) comprises a central feeder (23), first and second portions (38 and 40) coupled to the feeder. The first and second portions have first and second folded ends (42 and 44). The folded ends are in close proximity to each other and are electromagnetically coupled to each other. Thus, a modified folded dipole antenna is formed which receives and/or transmits radio signals in at orthogonal orientations.

2 Claims, 2 Drawing Sheets

FOLDED DIPOLE ANTENNA

This is a continuation of application Ser. No. 07/709,247, filed on Jun. 3, 1991 and now abandoned.

TECHNICAL FIELD

This invention relates generally to antennas, and more specifically to antennas having characteristics of loop antennas and folded dipole antennas.

BACKGROUND

Referring to FIG. 1A, there is shown a wristwatch radio 10 having a known antenna system. The antenna system includes a a first loop antenna 16 mounted on the wrist band and a second loop antenna 18 attached to the radio housing 12. The direction of the H field is along the axis of the helix and the direction of the E field is orthogonal to the plane of the front face of the wristwatch radio 10. The two loop antennas are oriented perpendicular from each other so that the radio receives E and H field signals in different orientations.

Referring to FIG. 1B there is shown an exploded view of the loop antenna 18 of the of the antenna system of FIG. 1A. The second loop antenna includes a conductive helix 21 wrapped around a ferrite core 19. The direction of the H field is indicated by an arrow passing along the axis of the helix 21.

If the wristwatch radio 10 had only one of the antennas reception would be poor when the person wearing the wristwatch radio 10 places the wristwatch radio 10 in an orientation not suitable for the antenna to properly receive signals. Therefore, two antennas are required for good reception and/or transmission. However, having two antennas requires more space in the radio and increases the complexity, quality and cost of the radio. Thus, it is desirable to have an antenna suitable for use on a wristwatch radio that operates well in various orientations.

SUMMARY OF THE INVENTION

Briefly, according to the invention, a modified folded dipole antenna comprises a central feeder, first and second portions coupled to the feeder. The first and second portions have first and second folded ends. The folded ends are in close proximity to each other and are electromagnetically coupled to each other. Thus, a modified folded dipole antenna is formed which receives and transmits radio signals in orthogonal orientations.

DETAILED DESCRIPTION OF THE PREFERRED EMBODIMENT

Figure 1A:
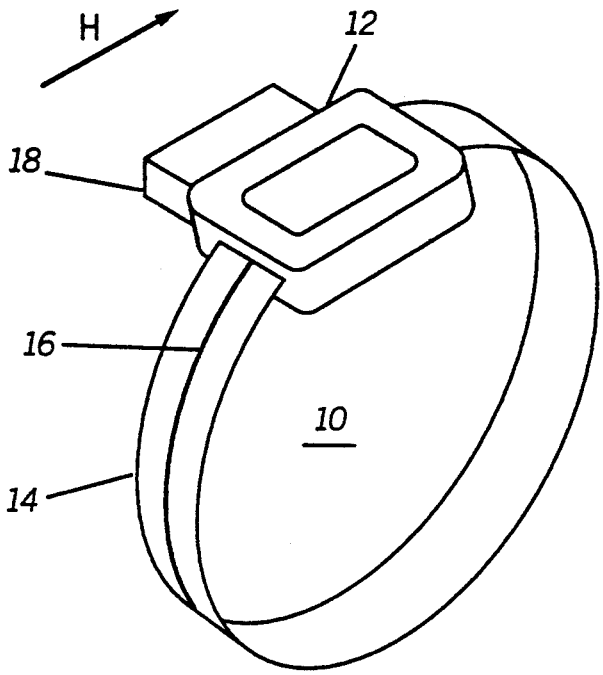
FIG.1A (PRIOR ART)
FIG. 1A shows a wrist worn radio having a known antenna system.
Figure 1B:
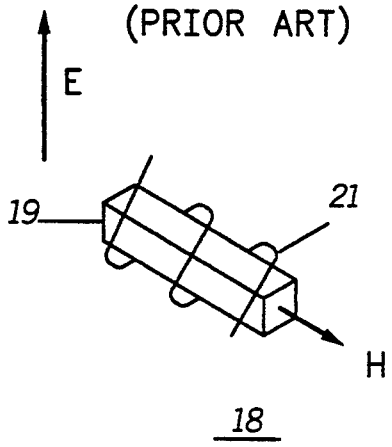
FIG.1B (PRIOR ART)
FIG. 1B shows an exploded view of one of the loop antennas of the of the antenna system of FIG. 1A.
Figure 2:
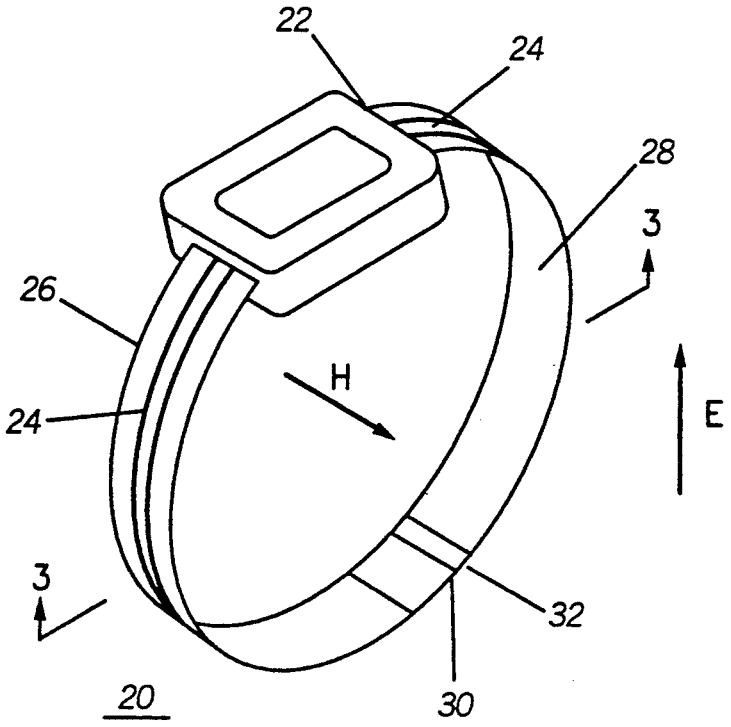
FIG. 2 shows a wrist worn radio 20 having an antenna in accordance with the invention.

Referring to FIG. 2 there is shown a wrist worn radio 20 having an antenna in accordance with the invention. The radio 20 comprises a modified folded dipole antenna modified to receive both H field and E field signals in different orientations. Thus, the invention eliminates the need for an additional antenna. The radio 20 comprises a housing 22 containing both timekeeping and radio circuitry. A wrist band 26 is attached to the housing 22 so that the radio 20 may be conveniently worn by a user. The band 26 has a microstrip outer portion 24 located on its outer surface and an inner portion 28 located on its inner surface. Any conductive strip could be used to implement the antenna. The band 26 is held on the user's wrist by means of a buckle. The buckle has a first member 30 which attaches to a second member in any of several known ways.

Figure 3:
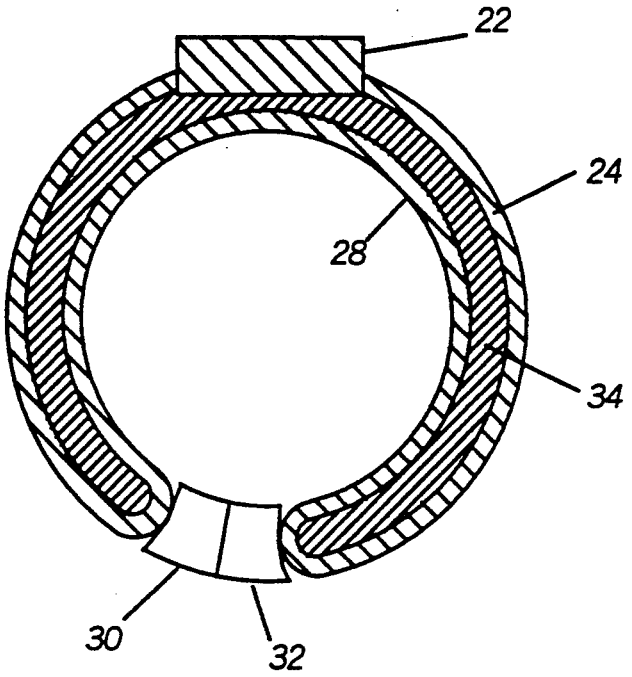
FIG. 3 is a section view taken along line A—A of FIG. 2

Referring to FIG. 3, there is shown a cross section. The antenna has first and second terminals coupled to a feeder in the radio housing. The outer portion 24 of the antenna is separated from the inner portion 28 by a spacer 34 which may be made from a material having the desired dielectric constant for operation at a given frequency. The buckle 30/32 may operate as a capacitive coupling between the one part of the antenna and the other.

Figure 4:
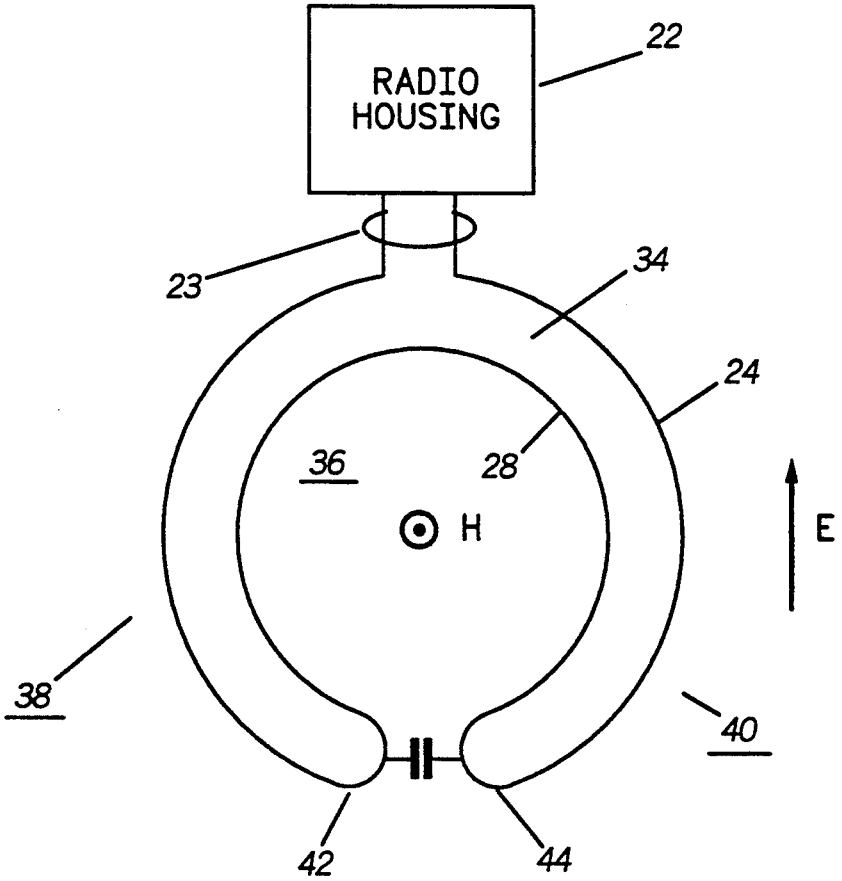
FIG. 4 shows an electrical model of an antenna in accordance with the invention.

Referring to FIG. 4, there is shown an electrical model of an antenna 36 in accordance with the invention. The antenna 36 has a first portion 38 and a second portion 40. The first portion 38 has a first folded end 42 and the second portion 40 has a second folded end 44. The first folded end 42 is capacitively coupled to the second folded end 44. The antenna 36 is coupled to the radio housing 22 via a feeder 23.

The antenna 38 receives H fields (shown as a circled dot representing flux passing through the plane of the page) and E fields (shown as an arrow or vector pointing to the top of the page. Thus, a modified folded dipole antenna is provided that overcomes the detriments of the prior art by operating in orthogonal directions, and by having a simpler design.

What is claimed is:

1. A radio suitable to be worn around a human wrist, comprising:

a radio housing;

a strap attached to the housing;

a modified folded dipole antenna for receiving and transmitting radio signals in orthogonal orientations, the modified folded dipole antenna being disposed along an outer portion and an inner portion of the strap and comprising:

central feeder means in said radio housing;

a first portion coupled to the central feeder means, the first portion having a first folded end;

a second portion coupled to the central feeder means, the second portion having a second folded end; and the first and second folded ends being in close proximity to each other, and being capacitively coupled to each other by a buckle.

2. A radio suitable to be worn around a human wrist, comprising:

a radio apparatus comprising an antenna port;

a radio housing containing the radio apparatus;

a band attached to the radio housing, the band having an outer surface and an inner surface, and a first end and a second end; and a modified folded dipole antenna for receiving and transmitting radio signals in orthogonal orientations, the modified folded dipole antenna comprising:

a conductive strip located along the inner and outer surfaces of the band, the conductive strip having a first and second ends coupled to the antenna port on the radio housing, and the conductive strip having two folds each leading from the outer surface to the inner surface of the band and being capacitively coupled by a buckle.

* * * * *